US006902036B1

(12) United States Patent
Holley

(10) Patent No.: US 6,902,036 B1
(45) Date of Patent: Jun. 7, 2005

(54) STABILIZER FOR FOLDING STEP LADDERS

(76) Inventor: Jack W. Holley, 11342 Gardenview L #1, St. Ann, MO (US) 63074

( * ) Notice: Subject to any disclaimer, the term of this patent is extended or adjusted under 35 U.S.C. 154(b) by 0 days.

(21) Appl. No.: 10/361,044

(22) Filed: Feb. 7, 2003

(51) Int. Cl.[7] ..... E06C 7/00
(52) U.S. Cl. ..... 182/180.2
(58) Field of Search ..... 182/180.2, 180.3, 182/180.1, 165, 176; 248/346.01, 346.02, 248/346.3, 346.5, 347.07

(56) References Cited

U.S. PATENT DOCUMENTS

| | | | | |
|---|---|---|---|---|
| 141,126 A | | 7/1873 | Eagon | 182/180.3 |
| 2,634,037 A | | 4/1953 | Bortel | 182/180.3 |
| 2,743,049 A | * | 4/1956 | Flesher | 182/176 |
| 4,637,626 A | * | 1/1987 | Foss et al. | 280/655 |
| 5,141,076 A | | 8/1992 | Joyce et al. | 182/108 |
| 5,370,204 A | | 12/1994 | Fox | 182/156 |
| 5,417,302 A | | 5/1995 | McElfresh | 182/102 |
| 5,791,435 A | | 8/1998 | Garnett | 182/107 |
| 5,791,438 A | | 8/1998 | Kempton | 182/200 |
| 5,927,669 A | * | 7/1999 | Sassman | 248/346.01 |
| 6,116,379 A | | 9/2000 | Huss | 182/165 |
| 6,253,876 B1 | * | 7/2001 | Cosgrave et al. | 182/180.2 |
| 6,419,047 B1 | | 7/2002 | Adshead | 182/180.2 |

* cited by examiner

*Primary Examiner*—Alvin Chin-Shue
(74) *Attorney, Agent, or Firm*—Grace J. Fishel

(57) ABSTRACT

A ladder is equipped with a stabilizing device. The stabilizing device resists movements of the ladder's feet which would occur in response to movements of a ladder's user while on the ladder. The stabilizing device holds the ladder's feet and provides transverse and longitudinal structure to provide counter forces to the ladder's feet to hold the ladder's feet against movement. The stabilizing device may have rigid bars forming a box structure extending between the ladder's feet or may be formed as a solid panel. The stabilizing device may be retrofitted to existing ladders.

8 Claims, 5 Drawing Sheets

STABILIZER FOR FOLDING STEP LADDERS

BACKGROUND OF THE INVENTION

1. Field of the Invention

The present invention relates to a stabilizer for a folding step ladder such that the feet of the ladder do not spread laterally or transversely from the weight and movement of a user on the ladder.

2. Brief Description of the Prior Art

It is known to incorporate braces into ladders, such as folding step ladders. The bracing may be added to increase ladder strength and to prevent twisting and flexing of the ladder. Other conventional bracing may be used to provide a stable footing for the ladder so that it will remain in place when placed on uneven ground. Also, some forms of conventional bracing may be used to provide an anti-slip contact surface on the ladder feet.

The following U.S. patents are incorporated by reference herein: U.S. Pat. Nos. 141,126, 2,634,037, 5,141,076, 5,370,204, 5,417,302, 5,791,435, 5,791,438, 6,116,379 and 6,419,047.

BRIEF SUMMARY OF THE INVENTION

The feet of an ordinary folding step ladder tend to slip laterally and transversely under the weight and movement of a user. In construction of housing and other buildings it is often more convenient or expedient to install floor tile or other flooring before the electrical, plumbing or ceiling installations are completed. When the flooring is secured by an adhesive, such as a conventional mastic, it will be several days after installation before the mastic is completely cured and the floor tile or other flooring is securely fastened to the substrate.

If a ladder is placed on an uncured floor, during completion of the installation of electrical wiring for example, the feet of the ladder will move against the floor tile or other flooring in response to movement of a user in climbing or working on the ladder. The movement of the ladder's feet may push the floor tile or other flooring out of position or may loosen it. This dislocation of the floor tile or other flooring can result in an unsightly surface and require the flooring installer to be called back to correct the damage. Even if the mastic is set, other damage may be done by sliding a ladder across the floor because the legs tend to grab the flooring making the ladder bounce, chatter and dance across the floor. This may mar the flooring, catch a seam of carpeting or cause other damage.

A folding step ladder outfitted with the stabilizing device of the invention has increased stability, particularly on surfaces that may shift in response to movement of a ladder's feet. The stabilizing device of the invention reduces movements of a ladder's feet during use. In particular, the device of the invention resists movement of the ladder's feet by providing a structure which operates adjacent to the ladder's feet to provide a resistive force to the incipient movement of the ladder's feet. The structure provides resistive forces to incipient transverse and longitudinal movement and to torsional forces which are experienced at the feet of the ladder.

In view of the above, it is an object of the present invention to provide a stabilizing device for a folding step ladder that resists incipient movement of the feet of the ladder during use. It is another object to provide a stabilizing device for a folding step ladder which tends to prevent floor damage by the legs of the ladder when the ladder is used or slid across the floor. Other objects and features of the invention will be in part apparent and in part pointed out hereinafter.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

Figure 1:
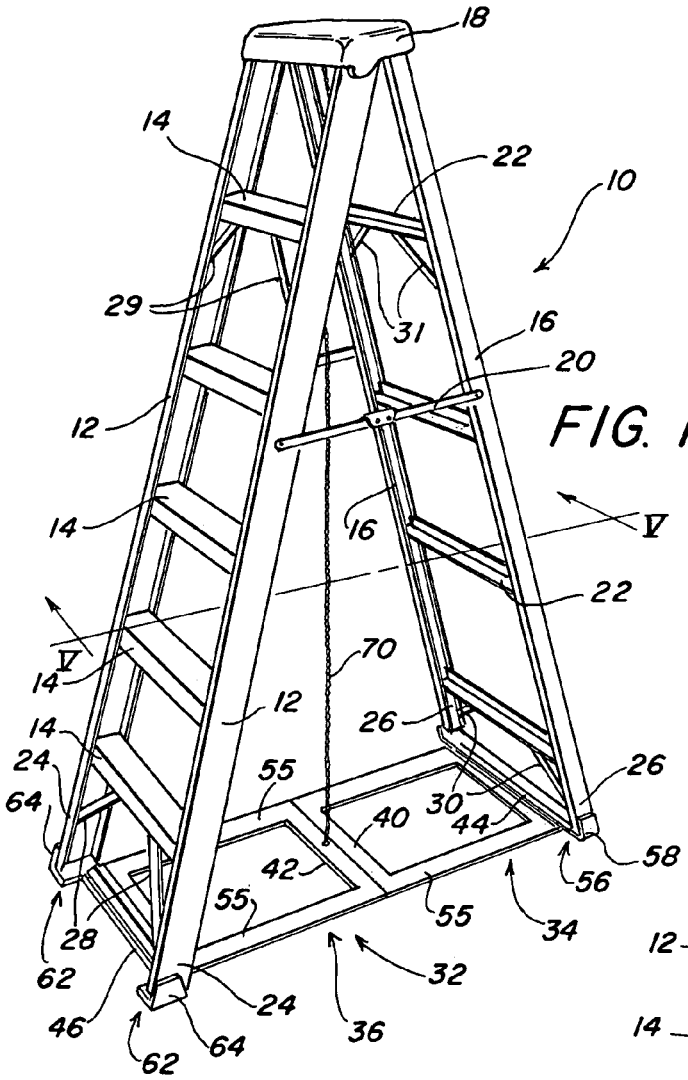
FIG. 1 is a perspective view of a erected ladder incorporating a stabilizing device in accordance with the present invention.
Figure 2:
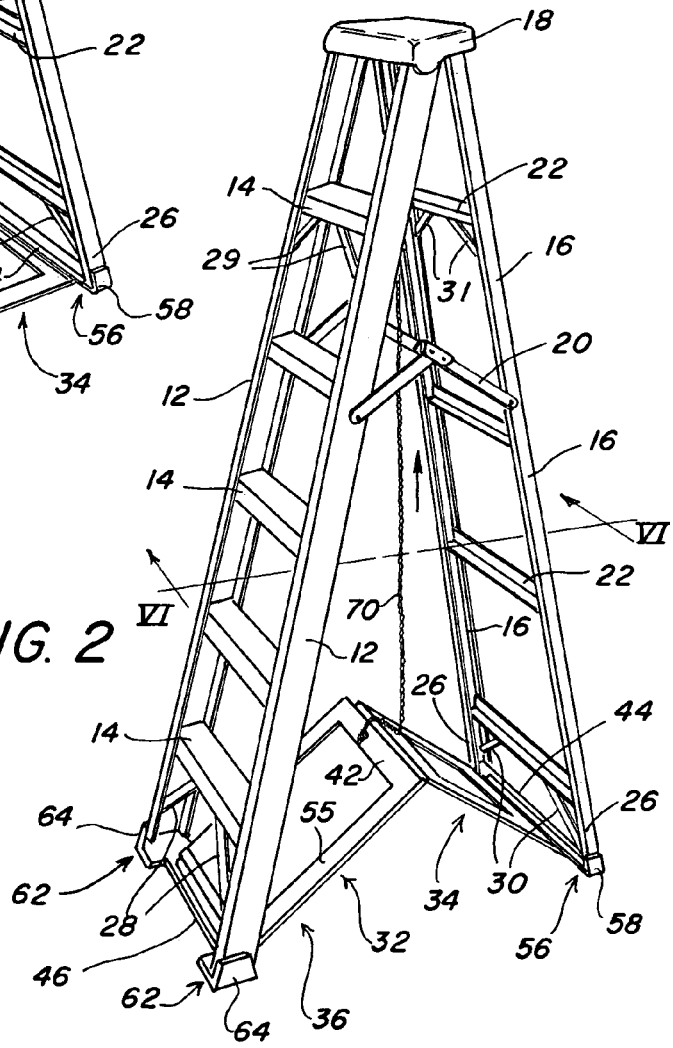
FIG. 2 is a perspective view of the ladder of FIG. 1 in a partially retracted position.

Referring to FIGS. 1 and 2, a folding step ladder 10 is shown. Ladder 10 may be made of wood or other material and is shown as a conventional metal ladder, such as an aluminum ladder, and is modified as is disclosed herein. Ladder 10 has a pair of front legs 12 which are equipped with steps 14 extending transversely therebetween. Ladder 10 also has a pair of back legs 16, as shown. As is known in the art, ladder 10 may also have a paint platform, not shown.

Figure 4:
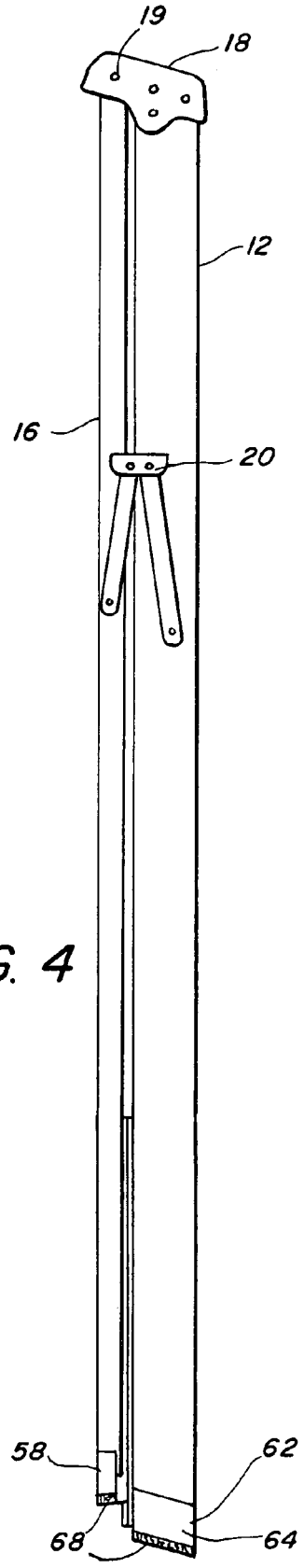
FIG. 4 is a right side view of the ladder shown in FIG. 3.

Front legs 12 and back legs 16 extend to a top cap or platform 18 to which they are joined. Back legs 16 pivot about a pivot pin 19 connected to top cap or platform 18 such that they fold against front legs 12, as shown in FIGS. 2 and 4. Front legs 12 are also connected to back legs 16 by a pair of folding spreader braces 20. Folding spreader braces 20 may be selectively locked to hold ladder 10 in the fully erected position shown in FIG. 1 and may also be pivoted out of locking position to allow ladder 10 to be folded, to be stored for example, as shown in FIGS. 2 and 4.

Figure 3:
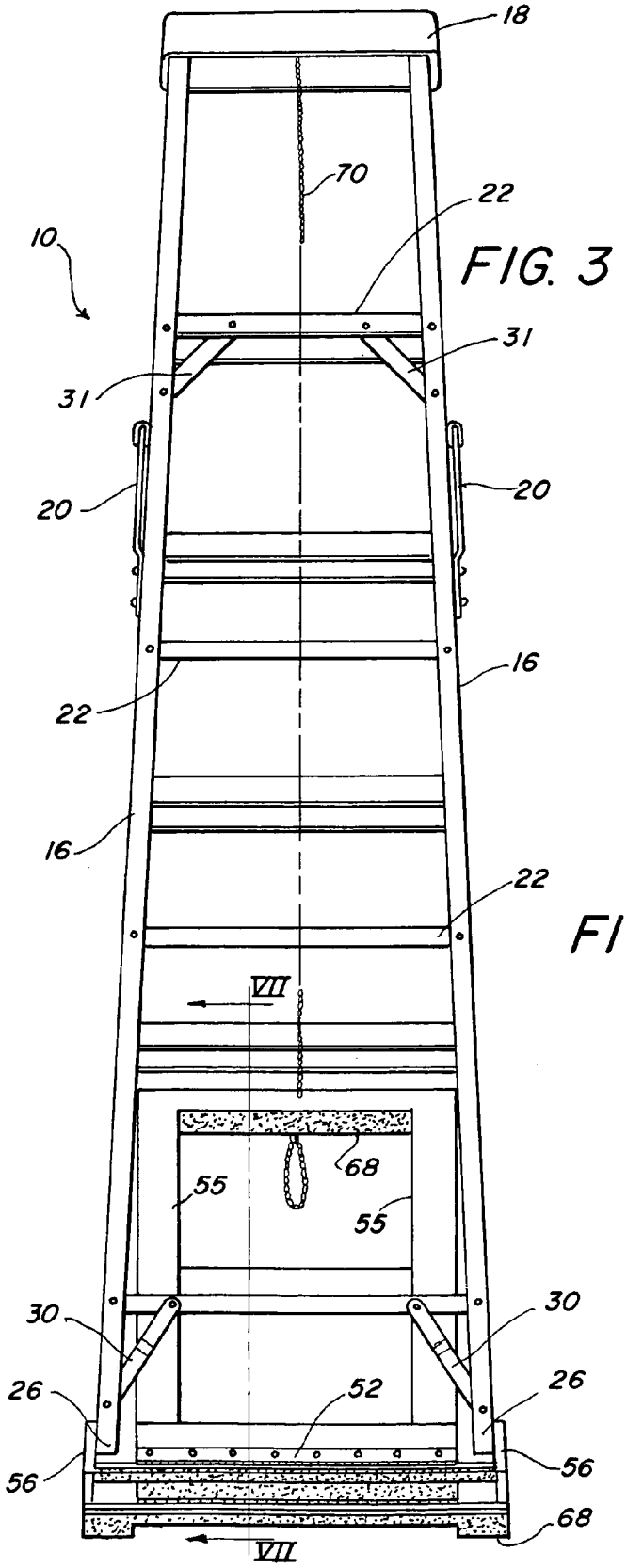
FIG. 3 is a back plan view of the ladder of FIG. 1 in a fully retracted position.

As shown in FIGS. 1 and 2, back legs 16 may have transversely extending braces 22 for additional strength or may have cross bracing, not shown, as is known in the art. Front legs 12 terminate in a pair of feet 24. Back legs 16 terminate in a pair of feet 26. Front feet 24 and back feet 26 may be supported by the stabilizing device of the invention, as described more fully herein. In addition, front legs 12 and back legs 16 may be provided with additional angle braces 28, 29, 30 and 31. Angle braces 28 and 29 are shown in FIGS. 1, 2 and 3 as attached to the front legs 12 and the top and bottom transverse step members 14. Angle braces 30 and 31 are shown in FIG. 3 as attached to back legs 16 and top and bottom transverse braces 22.

Figure 5:
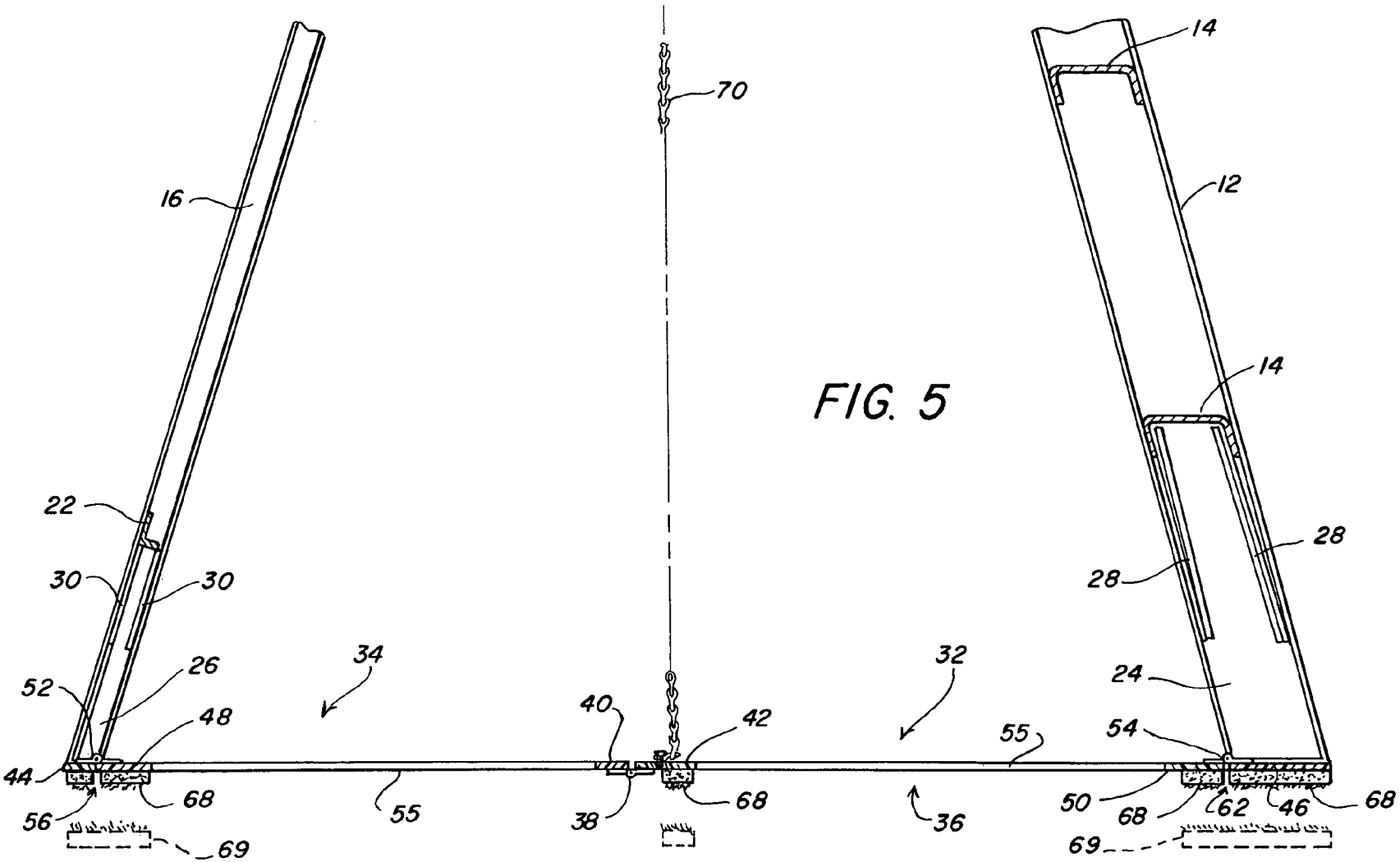
FIG. 5 is a partial cross-sectional view of the ladder and device of the invention taken along the plane V—V, shown in FIG. 1 and additionally showing detachable pads.
Figure 6:
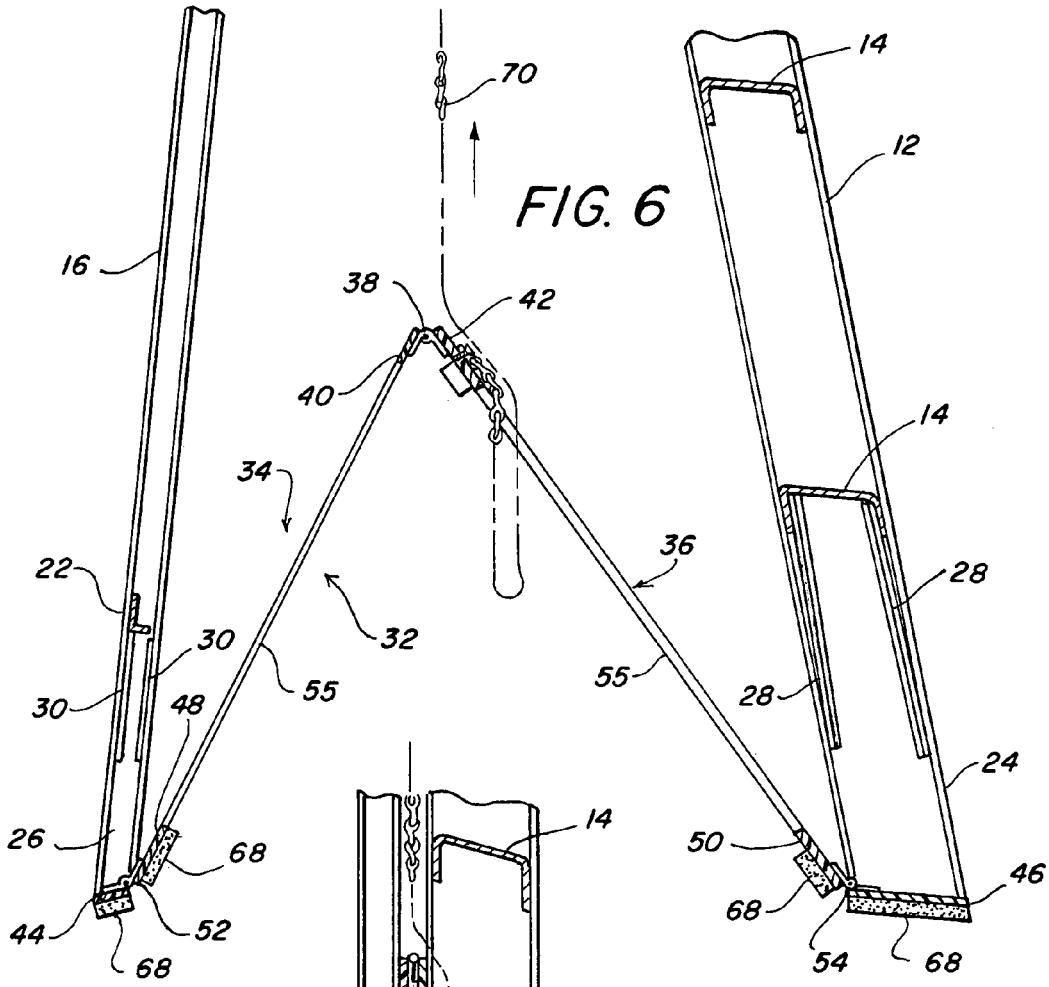
FIG. 6 is a partial cross-sectional view of the ladder and device of the invention taken along the plane VI—VI, shown in FIG. 2.
Figure 7:
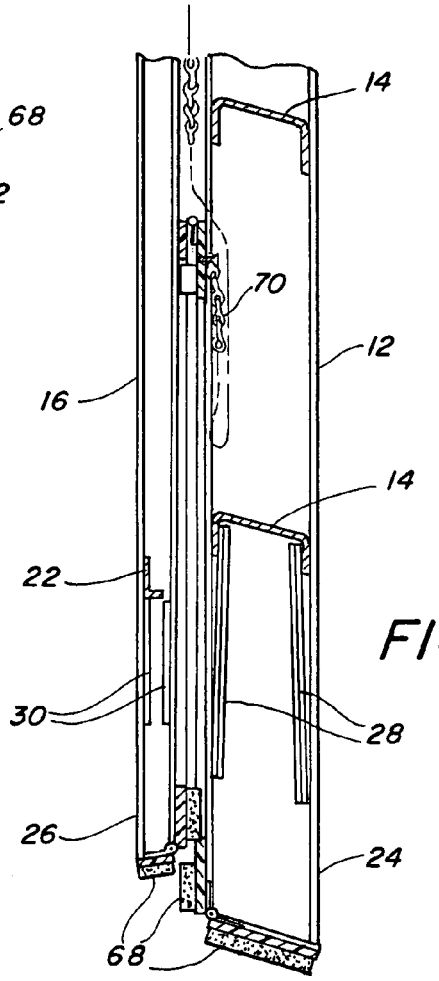
FIG. 7 is a partial cross-sectional view of the ladder and device of the invention taken along the plane VII—VII, shown in FIG. 3.
Figure 8:
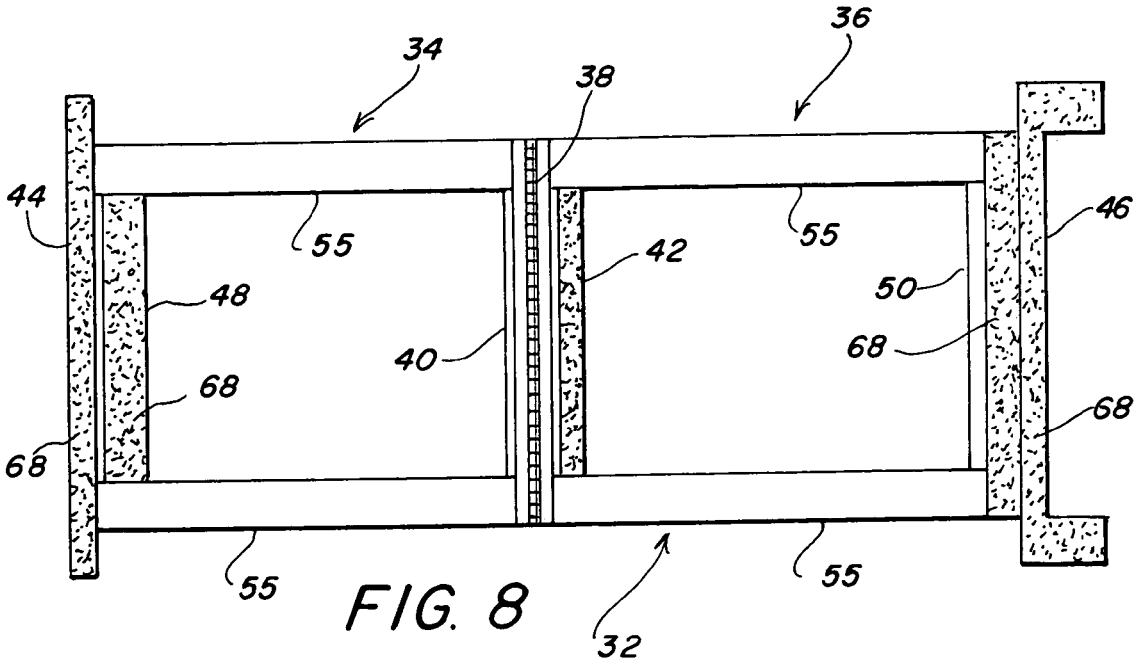
FIG. 8 is a bottom plan view of the device of the invention.

As shown in FIGS. 1, 2, 5 and 6, ladder 10 is equipped with a stabilizing device of the invention, shown as element 32. Stabilizing device 32 has two rectangular frames 34 and 36 which are pivotally joined in the middle by a hinge, for example a piano hinge 38, which is connected to center transverse members 40 and 42 of rectangular frames 34 and 36, respectively. Rectangular frames 34 and 36 also have distal transverse members 44 and 46, as shown. Distal transverse members 44 and 46 are pivotally joined to inner transverse members 48 and 50 by hinges, for example piano hinges 52 and 54, as shown in FIGS. 5 and 6. Piano hinges 38, 48 and 50 have a high degree of rigidity which this type of hinge provides, however, other hinge structures may also be used. Longitudinal members 55 complete rectangular frames 34 and 36. It will be appreciated by those skilled in the art that rectangular frames 34 and 36 may also be formed of rectangular sheets, and the like.

As shown in FIGS. 1 and 5, distal member 44 spans back legs 16 and may have receivers 56 at opposite ends thereof. Receivers 56 receive ends 26 of legs 16, as shown. Receivers 56 may have flanges 58 which extend upwardly and lie adjacent lateral sides of legs 16, as shown in FIGS. 1 and 2. Flanges 58 may be attached directly to legs 16 of ladder 10 by conventional adhesives and/or fasteners, such as screws, rivets or bolts, to provide a firm, stable attachment, with or without first removing the end caps normally attached to the ends of ladder legs 16.

Distal transverse member 46 spans front legs 12 and may have receivers 62 at opposite ends of distal transverse member 46, as shown. Receivers 62 may have flanges 64 which extend upwardly and lie adjacent lateral sides of legs 12, also as shown in FIGS. 1 and 2. Flanges 64 of receivers 62 may be attached directly to legs 12 of ladder 10 by conventional adhesives and/or fasteners, such as screws, rivets or bolts, to provide a firm stable attachment.

As shown in FIGS. 3 through 9, some or all of transverse members 40 through 50, may have a protective material 68 attached to the under surface of those members. Protective material 68 may be any of a variety of cushioning and/or anti-slip materials. Suitable materials for protective material 68 include foam rubbers and foamed plastics such as polyether foam, polyurethane foam and equivalent materials. Other materials may also be used such as plastic and rubber sheet, carpeting or other textiles. Protective material 68 may also be made of nylon or the like such that ladder 10 slides easily or as shown in FIG. 5 of a combination of materials. With continuing reference to FIG. 5, protective material 68 may include a female attachment member such as the pile side of a VELCRO fastener and a detachable pad 69 formed of a slippery material such as nylon attached with a male attachment member like the hook side of a VELCRO fastener. When the pile side is exposed, ladder 10 can be slid across a tile floor, for example, and when detachable pad 69 is attached, ladder can be easily slid across a carpeted area. While male and female attachment members are shown, it will be understood that detachable pad 69 may be hinged to stabilizer device 32 or otherwise attached with means for selective deployment.

As shown in FIGS. 1 through 3 and 5 through 7, stabilizing device 32 has a retractor 70 attached near the center of stabilizing device 32 and connected to a point on ladder 10 such as the underside of top cap or platform 18, as shown. Retractor 70 may be a light chain, as shown, or a cord or other conventional flexible material, as is known in the art. Retractor 70 permits stabilizing device 32 to be folded around hinges 38, 52 and 54, by upward motion of retractor 70, as ladder 10 is folded to the closed position. Retractor 70 may add convenience to the use of stabilizing device 32, however, it will be appreciated by those skilled in the art that stabilizing device 32 may folded by lifting the center of stabilizing device 32 by hand or with a foot. The portion of cushioning or anti-slip material 68 under transverse member 42, or under transverse member 40, if used, protects stabilizing device 32 from damage and also permits stabilizing device 32 to be conveniently folded by placing a hand or foot under the center of the stabilizing device 32 and lifting the center of the stabilizing device 32.

Figure 9:
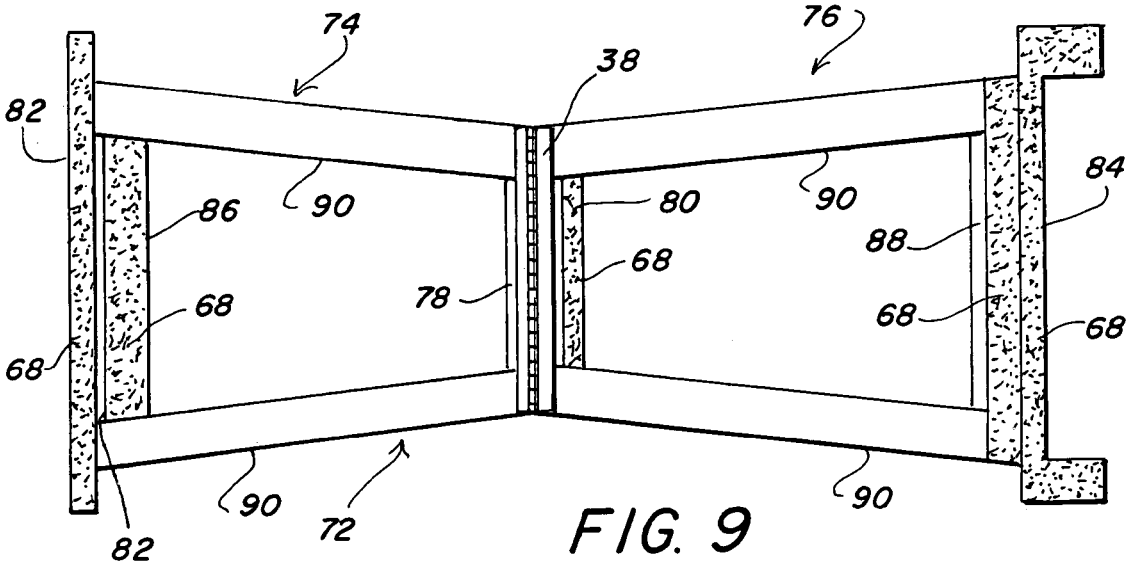
FIG. 9 is a bottom plan view of an alternative embodiment of the device of the invention.

FIG. 9 shows an alternative stabilizing device 72. The stabilizing device 72 has two trapezoidal frames 74 and 76, as shown. The trapezoidal frames have a plurality of transverse members, for example those shown as elements 78, 80, 82, 84, 86 and 88 which are analogous to the transverse members previously described for rectangular frames 34 and 36. Trapezoidal frames 74 and 76 have longitudinal members 90, which are angled in to fit more closely within the angled legs of ladder 10. It will be appreciated by those skilled in the art that trapezoidal frames 74 and 76 may also be formed of a solid sheet, as described above.

When ladder 10 is erected without stabilizing device 32 (or 72), a downward force on step 14, for example bottom step 14, flexes the center of the step downwardly. This flexure creates an incipient transverse movement of feet 24 which may displace tiles (or other flooring) on which ladder 10 is resting. In addition, as a user progresses up ladder 10 the downward force from the user's weight is moved toward the center of the ladder flexing the ladder and creating an incipient longitudinal movement of feet 24 and 26, which movement may also displace tiles on which ladder 10 is resting. It will be appreciated that during use of ladder 10 the movement of a user on the ladder will also create further translational and torsional forces on the ladder which will be transferred to feet 24 and 26.

When ladder 10 is erected with stabilizing device 32 (or 72) in place, the terminal extremities of feet 24 and 26 of legs 12 and 16 are held against lateral and transverse movement in response to forces on the ladder, from the weight and movement of the user for example. Transverse members 44 and 46 resist transverse displacing movements and longitudinal members 55 resist longitudinal displacing movements. Further, stabilizing device 32 may act as a shear panel to resist displacing movements resulting from torsional forces exerted on ladder 10 and transferred to feet 24 and 26 of legs 12 and 16. With stabilizing device 32 installed, the forces exerted on a floor on which the ladder 10 is used are essentially vertical forces. Ladder 10 may be used, and work performed using ladder 10, on tiled floors which have been recently installed, and for which the adhesive has not cured. Ladder 10 will not displace the tiles and prevents damage to the tiled floor which would require further work to repair the damage.

As will be appreciated by those skilled in the art, stabilizing device 32 (or 72) may be made by a variety of conventional methods and of a variety of conventional materials. Stabilizing device 32 may be made of metal, for example aluminum, wood, or plastic materials, for example nylons, polypropylenes, polyethylenes or similar materials. Stabilizing device 32 may be made by laying up elements of the device and joining the elements by conventional fasteners and/or adhesives. Stabilizing device 32 may be welded if the appropriate materials, such as metals, are used. In addition, stabilizing device 32 may be made, by conventional molding, stamping and cutting techniques, as a few unitary pieces which require only joining by hinges and the like and the addition of cushioning and anti-slip padding 68. It will also be appreciated that with conventional molding techniques, for plastics and the like, that stabilizing device 32 can be produced with the hinges molded in with the other structural components.

It will be understood by those skilled in the art that the description given herein are for purposes of illustration. For example, while the use of the ladder and stabilizing device of the invention is described in relation to its use over freshly installed flooring, the ladder and stabilizing device of the invention may be used for many purposes in which stability of a ladder is desired. The structure disclosed herein may be further modified without departing from the spirit of the invention. The invention disclosed herein is not to be limited to the embodiments disclosed herein by way of example, but only by the scope of the appended claims and their equivalents.

What is claimed:

1. A folding ladder having front and rear legs and a stabilizing device, said device having first and second frames, a first transversely extending hinge hinging said first and second frames together, a second and a third hinge parallel the first hinge, said second hinge transversely hinging said first frame to a first transverse member attached to and between the front legs of the ladder, said first transverse member resisting lateral movement of the front legs in response to forces applied to the ladder and said third hinge transversely hinging said second frame to a second transverse member attached to and between the rear legs of the ladder, said second transverse member resisting lateral movement of the rear legs in response to forces applied to the ladder, said first and second frames interconnecting the front and rear legs for resisting longitudinal movement of the legs in response to forces applied to the ladder, said first and second frames having a length that fits between the front and rear legs whereby the frames can be folded between the front and rear legs.

2. The stabilizing device of claim 1 wherein the first, second and third hinges are piano hinges.

3. The stabilizing device of claim 2 wherein the first transverse member has a flange at first and second ends adapted for attachment to an outside edge of the front legs.

4. The stabilizing device of claim 3 wherein the second transverse member has a flange at first and second ends adapted for attachment to an outside edge of the rear legs.

5. The stabilizing device of claim 1 wherein a protective material is applied to a floor contacting portion of the first and second transverse members.

6. The stabilizing device of claim 5 wherein the protective material includes a first layer of anti-slip material and a second layer of slippery material with means for selective deployment of the second layer of slippery material over the first layer of anti-slip material.

7. The stabilizing device of claim 1 wherein a retractor is attached at an intermediate location on the first and second frames.

8. The stabilizing device of claim 7 wherein the retractor is a flexible element.

* * * * *